US007877963B2

(12) United States Patent
Messing et al.

(10) Patent No.: US 7,877,963 B2
(45) Date of Patent: Feb. 1, 2011

(54) METHOD OF PRODUCING A SEALED BUNDLE OF CONSUMER ARTICLES

(75) Inventors: Julian Gregory Messing, Warwickshire (GB); Philippe Bourgoin, Cheseaux (CH); Pierre-Yves Gindrat, Saillon (CH)

(73) Assignee: Philip Morris USA Inc., Richmond, VA (US)

( * ) Notice: Subject to any disclaimer, the term of this patent is extended or adjusted under 35 U.S.C. 154(b) by 359 days.

(21) Appl. No.: 12/078,563

(22) Filed: Apr. 1, 2008

(65) Prior Publication Data

US 2008/0245685 A1 Oct. 9, 2008

(30) Foreign Application Priority Data

Apr. 5, 2007 (EP) ..... 07105792

(51) Int. Cl.
*B65B 19/24* (2006.01)

(52) U.S. Cl. ..... 53/412; 53/463

(58) Field of Classification Search ..... 53/412, 53/452, 456, 558, 574, 575, 133.7, 133.8, 53/209, 463; 493/175, 252; *B65B 19/24*
See application file for complete search history.

(56) References Cited

U.S. PATENT DOCUMENTS 1,885,910 A 11/1932 Gwinn et al.
2,603,925 A * 7/1952 Moore ..... 53/575
2,625,775 A * 1/1953 Tamarin et al. ..... 53/412
3,416,410 A 12/1968 Whitaker
3,481,098 A * 12/1969 Sherrill et al. ..... 53/412
3,511,014 A * 5/1970 Kochalski ..... 53/233
3,590,556 A 7/1971 Focke
3,978,639 A * 9/1976 Ferrozzi ..... 493/252
4,241,564 A * 12/1980 Quarenghi ..... 53/575
4,807,745 A * 2/1989 Langley et al. ..... 206/245
4,862,680 A * 9/1989 Krah ..... 53/575
5,003,755 A 4/1991 Draghetti
5,465,554 A * 11/1995 Lewis et al. ..... 53/466
5,542,529 A * 8/1996 Hein, III et al. ..... 206/245
5,588,286 A * 12/1996 Focke et al. ..... 53/575

(Continued)

FOREIGN PATENT DOCUMENTS

DE 920057 C 11/1954

(Continued)

OTHER PUBLICATIONS

Partial European Search Report (R. 46 EPC) dated Jul. 9, 2007 for European Application No. 07105792.

(Continued)

*Primary Examiner*—Stephen F Gerrity
(74) *Attorney, Agent, or Firm*—Buchanan Ingersoll & Rooney PC

(57) ABSTRACT

A method of producing a sealed bundle containing consumer articles such as smoking articles comprises the steps of wrapping a sealable material around an outer surface of a sleeve; at least partially sealing the sealable material while being wrapped around the sleeve at its bottom and along its length; pushing a group of smoking articles through the sleeve to remove the partially sealed sealable material from the sleeve; and sealing the partially sealed sealable material at the top so as to form the sealed bundle.

10 Claims, 3 Drawing Sheets

U.S. PATENT DOCUMENTS

| | | | | | |
|---|---|---|---|---|---|
| 5,590,513 | A | * | 1/1997 | Belvederi | 53/575 |
| 5,819,924 | A | * | 10/1998 | Sigrist et al. | 206/264 |
| 6,000,539 | A | * | 12/1999 | Stewart-Cox et al. | 206/264 |
| 6,125,611 | A | * | 10/2000 | Focke | 53/225 |
| 6,138,437 | A | * | 10/2000 | Focke et al. | 53/133.7 |

FOREIGN PATENT DOCUMENTS

| | | | | |
|---|---|---|---|---|
| DE | 3142307 | A1 | * | 7/1982 |
| EP | 0751069 | A1 | | 1/1997 |
| EP | 835810 | A1 | * | 4/1998 |
| EP | 1574435 | A2 | | 9/2005 |
| EP | 1686060 | A1 | | 8/2006 |
| GB | 2088816 | A | | 6/1982 |

OTHER PUBLICATIONS

Partial International Search Report dated Aug. 26, 2008 for PCT/EP2008/054062.

Official Communication dated Sep. 23, 2010 for European Patent Appln. No. 08735803.2.

* cited by examiner

METHOD OF PRODUCING A SEALED BUNDLE OF CONSUMER ARTICLES

CROSS-REFERENCE TO RELATED APPLICATION

This application claims priority under 35 U.S.C. §119 to European Application No. 07105792.1, filed Apr. 5, 2007, the entire content of which is hereby incorporated by reference.

FIELD OF THE INVENTION

The invention relates to a method of producing a sealed bundle for storing and dispensing consumer articles, in particular smoking articles, for example cigarettes.

BACKGROUND

Smoking articles, particularly cigarettes, are most commonly packed in hinge-lid packs, slide-and-shell packs, hard cup packs or soft cup packs. To preserve the freshness of said smoking articles, a common approach is sealing the packs, especially hinge-lid packs, with a barrier material such as polypropylene wrapper. Alternatively, the smoking articles may be sealed as a bundle inside a single sealable material without additional protective layers.

For example, EP-A-751,069 discloses a method to make such a sealed bundle. In a first step a sealable material is introduced into a U-shaped pocket of a packing device for smoking articles. In a second step the group of smoking articles is moved into the U-shaped pocket. In a third step the sealable material is closed around the group of smoking articles. In a final step the sealable material is sealed around the group of smoking articles, thus forming the sealed bundle.

The prior art method has the disadvantage, that the sealable material is sealed while the smoking articles are already contained in the sealable material. Thus the sealing of the sealable material is performed against the smoking articles and may potentially expose the smoking articles to an undesirable amount of local heat.

A further method avoiding this disadvantage is disclosed in EP-A-1,686,060. Also in this case, the smoking articles are introduced into a sealable material shaped into a U-form. The sealable material is then sealed aside of the group of smoking articles, instead of being backed by the smoking articles. The disadvantage of this method is that additional folding operations are required as well as additional sealable material.

SUMMARY

The present invention provides a novel and improved method for producing a sealed bundle containing smoking articles which avoids the discussed disadvantages and maintains the quality of the consumer articles within. In particular, the method of producing a sealed bundle containing consumer articles such as smoking articles according to the invention comprises the steps of: wrapping a sealable material around the outer surface of a sleeve; at least partially sealing the sealable material while it is wrapped around the sleeve at its bottom and along its length; pushing a group of smoking articles through the sleeve so as to remove the partially sealed sealable material from the sleeve; and sealing the partially sealed sealable material at the top so as to form the sealed bundle.

The shape of the sleeve and the collation of the consumer articles within determine the shape of the sealed bundle. The sealed bundle may have a cross section that exhibits zero or an integer number of corners, forming for example a circle, oval, ellipse, semi-circle, semi-ellipse, triangle, quadrate, rectangle, hexagon, octagon, or any other shape. Particularly preferred are circle-like or ellipse-like shapes, shapes including lines of symmetry such as two semi-circles or semi-ellipses attached to each other along their base lines forming a shape with two corners and two curved edges in symmetry to each other, or rectangles that provide for parallelepiped-shaped packs.

Usually, a number of articles, for example 20, is contained in one sealed bundle of the invention. However, the subject sealed bundle may also include only one article, such as an exclusive smoking product, like a cigar, or a precious spice, like vanilla or cinnamon. In the case of smoking articles such as cigarettes, a preferred number of cigarettes contained in a single subject pack may vary between 5 and 30, with 7, 10, 13 or 20 being preferred.

The term "bundle" as used herein is meant to describe any group of wrapped consumer articles, either sealed or unsealed.

The term "seam" as used herein is meant to comprise any type of area, line or location where the sealable material is sealed.

The term "sealing" as used herein is meant to comprise any type of connecting parts of the sealable material in order to render the connection sufficiently gas-impermeable. The sealing may be performed for example through application or development of heat, such as heat sealing, welding, or the like, or by application of ultrasound, pressure, electromagnetic fields or the like.

The term "gas-impermeable" is to be understood as being sufficiently impermeable to gas in order to maintain a pressure difference between the bundle's inner space and the environment during the time the bundle has not been opened for the first time.

The term "maintain the quality" is to be understood as the consumer articles exhibiting essentially no difference between the state the articles in the packs have when leaving the factory and the state they have at the time of first opening of the pack with respect to all important product features, such as taste, smell, presence of microorganism, look and feel, water content, and all other physical, chemical or biological properties.

It is preferred, that the consumer articles get slightly compressed before they are pushed into the sleeve. This advantageously compensates the thickness of the sleeve once the consumer articles are removed again from the sleeve, preferably forming a tightly wrapped sealed bundle.

According to the method of the invention the tubular wrapping is sealed on two sides, that is along its length and at its bottom while being wrapped around the sleeve instead of being wrapped around the smoking articles. Only then the smoking articles are introduced in the tubular wrapping. Thus, the smoking articles will not be exposed to any heat during these two sealing operations.

The method according to the invention is particularly preferred where the group of smoking articles are filter cigarettes having a filter end and a tobacco rod end. Then, it is preferred that the filter cigarettes are pushed into the partially sealed sealable material with the tobacco rod end first. In that case the final sealing of the sealable material will be made against the filter end of the group of smoking articles. Generally, cigarette filters are not heat sensitive.

In a further preferred embodiment of the method according to the invention, the sealable material is wrapped around the sleeve such that first and second ends of the sealable material overlap to form a side seam which is then sealed. In this embodiment, overlapping flaps of the sealable material sealed along the side seam are then folded against a plane surface, the overlapping flaps forming a bottom seam when sealed. The plane surface is then removed from the sleeve so as to allow the group of smoking articles to be pushed through the inner channel of the sleeve into the partially sealed sealable material. This embodiment is particularly efficient from the manufacturing point of view.

Typically, a plurality of sleeves is arranged on the circumference of an indexing wheel of a packaging machine indexing through different positions in which certain steps of the method according to the invention are performed. On the indexing wheel, these steps are typically performed at the same time on different bundles.

In a further preferred embodiment of the method according to the invention, a holder is arranged close to the sleeve. The group of smoking articles is pushed through the inner channel of the sleeve in order to push the smoking articles together with the partially sealed sealable material from the sleeve into the holder. The tubular wrapping held by the holder is then closed at its top by folding overlapping flaps of the partially sealed sealable material against the ends of the smoking articles contained in the tubular wrapping to form a top seam. The tubular wrapping is then sealed along the top seam to form the sealed bundle. Again, this embodiment is particularly efficient from a manufacturing point of view. Typically, a plurality of holders is attached to a chain for further processing. After each final sealing operation the chain with the holders is indexed to the next position to receive the next bundle.

Preferably the sealable material is a mono-layer plastic film, for example made from oriented polypropylene or polyethylene terephthalate.

Such a sealed bundle may be used for example to provide sealed refill bundles for a refillable outer container, such as a standard hinge lid pack, a slide and shell pack, a special pack made from plastic or metal or any other suitable container to hold the sealed bundle of smoking articles. This advantageously reduces the overall amount of material needed, thus making this embodiment particularly cost-effective, at the same time reducing the amount of waste created. If desired the plastic film may be metalized to provide improved barrier properties for example improving the gas-impermeability of the sealed bundle.

In a further embodiment of the method according to the invention, the sealable material is a multi-layer film, for example a laminated film comprising a layered structure of oriented polypropylene-aluminum-oriented polypropylene or a layered structure of polyethylene terephthalate-aluminum-polyethylene terephthalate. Of course, it is also envisaged to use materials other than aluminum as the high barrier layer, for example ethylene vinyl alcohol copolymer or polyvinylidene chloride.

Further suitable sealable materials include, but are not limited to: metal/plastic laminate or combinations, plastic/metal/plastic laminate or combinations, plastic/paper/plastic laminate or combinations, metalized plastic foil, metalized paper, metalized cardboard, opaque plastic foil with no metal content, metal, alloy, and any combinations thereof. Preferably, a material containing one layer of aluminum, such as pure aluminum foil or aluminum/plastic laminate or combinations or plastic/aluminum/plastic laminate or combinations is used. As the plastic component usual polymers or polymer blends may be used. Suitable further polymers include, but are not limited to, polyolefines, preferably polyethylene and polypropylene, polycarbonates, polyurethanes and polystyrenes. The shell materials may further contain additives such as colorants, odorants, disinfectants, fillers and stabilizers. It is preferred if the outermost layer of the shell material is provided with colorants.

The layered structure of the sealable material is preferably such, that the front side of the sealable material is sealed to the back side of the same sealable material.

In a preferred embodiment of the method according to the invention, the outermost layer of the sealable material is printable. This is advantageous with respect to branding or the like. Different printing processes can be used. Reverse gravure printing may be preferred so that the design and graphics are protected by the outside layer. In this case the outside layer must then be at least partially transparent to allow the printing to be seen therethrough.

According to a preferred embodiment of the method according to the invention, the sealable material is provided with at least one tear tape for opening the sealed bundle. This provides for an easy opening of the sealed bundle. This tear tape may be located at different positions in the horizontal direction in order to provide a different access level depending on a particular product length.

Usually, a tear tape has a tab which may be easily grabbed to open the sealed bundle. A different tab position may be used depending on the final use of the sealed bundle. For example if the sealed bundle is used with different refillable containers such as hinge lid packs, slide and shell packs, soft packs or other that have different ways of opening and thus have various ways to get access to the tab. In this case the sealed bundle may comprise two or more tear tapes, for example three or four, so that at least one tear tape is at a convenient position regardless into which type of refillable container the sealed bundle is refilled.

Finally, a further subject of the present invention is a sealed bundle containing smoking articles obtained in accordance with any of the above-described embodiments of the method according to the invention.

BRIEF DESCRIPTION OF THE DRAWINGS

An embodiment of the method of producing a sealed bundle containing smoking articles according to the invention will now be described with reference to the accompanying drawings in which.

DETAILED DESCRIPTION

Figure 1:
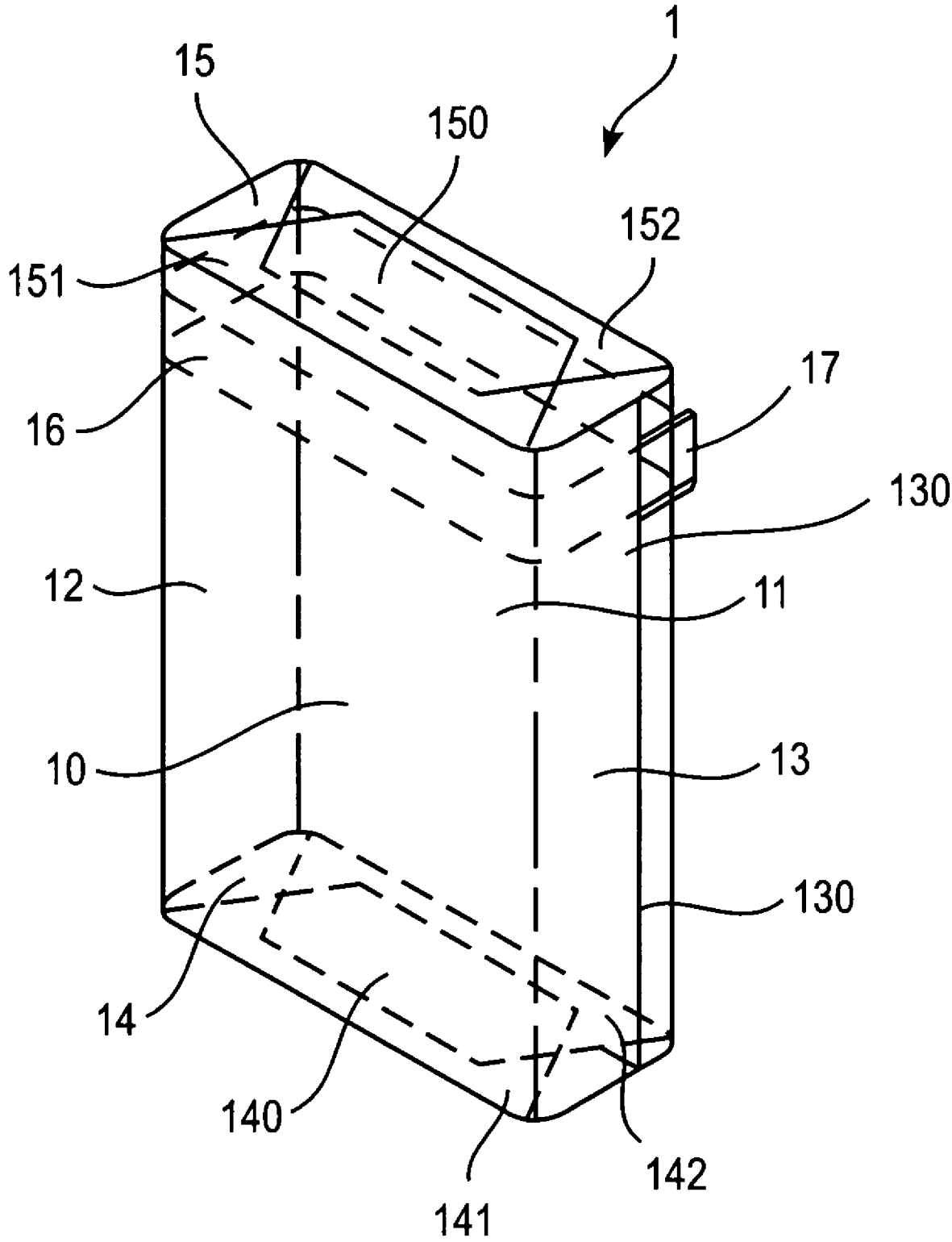
FIG. 1 shows an embodiment of a sealed bundle obtained using the method according to the invention.

FIG. 1 shows an embodiment of a sealed bundle obtained using the method according to the invention. The sealed bundle 1 is made from one sheet of sealable material and comprises a front 10, a back 11, two sides 12 and 13, a bottom 14 and a top 15. In addition, the sealed bundle 1 comprises a tear tape 16 with a tab 17. The tear tape 16, is intended for opening of the sealed bundle 1 so as to allow access to the smoking articles contained therein. The sealed bundle 1 further comprises a side seam 130 which is formed by an area where first and second ends of the sheet of sealable material overlap (only the outer overlapping end being visible in FIG. 1). The sealed bundle 1 further comprises short side flaps and long side flaps 141, 142 at the bottom that overlap and are sealed to each other in the area of overlap forming the bottom seam 140. The sealed bundle 1 further comprises at the top short side flaps and long side flaps 151, 152 at the top that overlap and are sealed to each other in the area of overlap forming the top seam 150.

Figure 2:
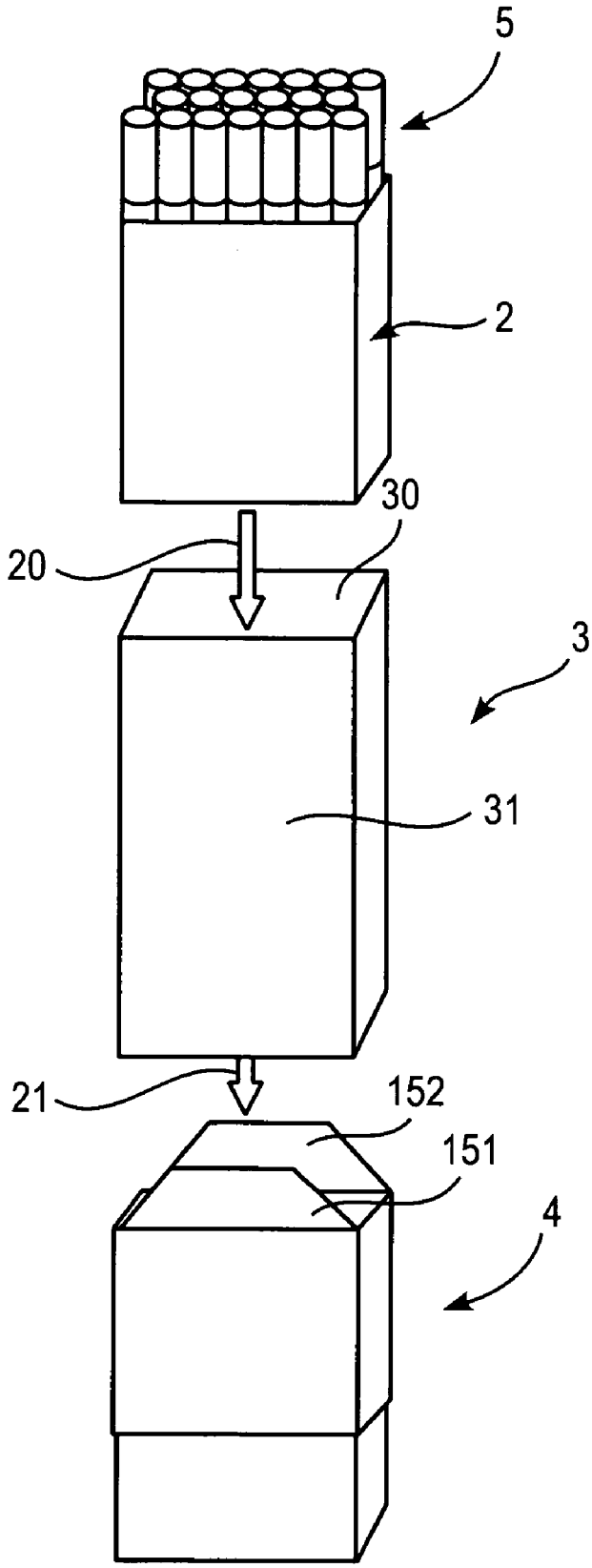
FIG. 2 schematically shows elements of the device used in one embodiment of the method according to the invention.

FIG. 2 shows elements of an embodiment of the device employed by the method according to the invention. Other features known to one skilled in the art like drives, control elements or the like are omitted for clarity. In this embodiment, a group of smoking articles 5 in a predetermined number, in this example twenty, and predetermined collation, in this example a 7-6-7 collation is provided in a compression pocket 2 close to a sleeve 3. An inner channel 30 extends through the sleeve 3. The inner channel 30 as well as the outer surface 31 of the sleeve 3 have a cuboid shape with a rectangular cross-section. Alternatively the sleeve 3 may have a different cross-section, for example triangular, hexagonal, circular, or other. The outer surface 31 of the sleeve 3 has a width 32 and a depth 33 which corresponds essentially to the inner width and depth of the sealed bundle 1 (see FIG. 3).

Figure 3:
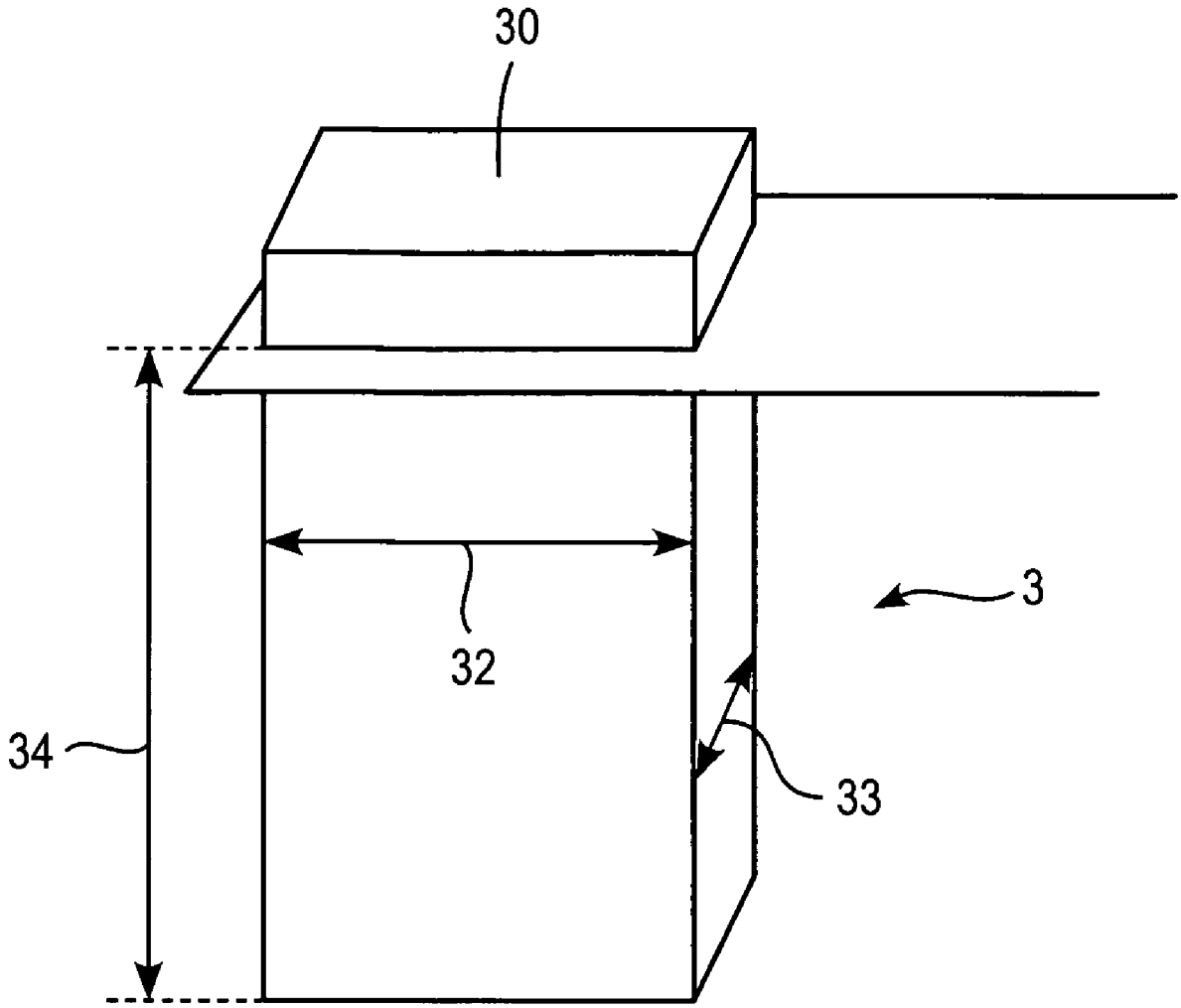
FIG. 3 schematically shows an sleeve used in the embodiment of the method according to FIG. 2.

As shown in FIG. 3, the sleeve 3 may be held near its top end, so that the sleeve has a length 34 between the location where the sleeve 3 is held and the bottom end of the sleeve 3. This length 34 corresponds at least to the length of the smoking articles wrapped inside the sealable material plus the length of the bottom flaps 141, 142 of the sealable material from which the bundle 1 is made.

In a first step the sheet-like sealable material is wrapped around the outer surface 31 of the sleeve 3 in a first step. The sheet-like material may be provided as continuous material from a roll and cut to size in an additional step prior to wrapping it around the outer surface 31 of the sleeve 3. The sealable material is then sealed along the side seam 130 (see FIG. 1). Sealing along the side seam 130 may be performed either by first sealing the sealable material only at a limited area of the side seam 130 so as to tack the sealable material and stabilize it about the sleeve. Then the sealing process may be completed along the entire side seam 130. Alternatively, the sealing process may be performed along the entire side seam 130 in a single step.

Once the sealable material has been sealed along the side seam 130, a plate (not shown) having a plane surface is pushed through the inner channel 30 to the bottom end of the sleeve 3. The two small side flaps (not shown) and the two long side flaps 141, 142 (see FIG. 1) are then folded against the abutment surface so as to overlap and form the bottom seam 140. Sealing is then performed along the bottom seam 140 against the plane surface of the plate so as to form the sealed bottom 14 (see FIG. 1). Sealing may again be performed either in a two-step operation or in a single-step operation as was already described above. The plate is then removed from the sleeve 3. Thus, as no smoking articles are present in the sleeve 3 at the time of the sealing of the side seam 130 and the bottom seam 140 it is impossible that tobacco may be exposed to heat developed by the sealing operation.

In a next step indicated by the first arrow 20 the group of smoking articles 5 provided in the compression pocket 2 is pushed through the inner channel 30 of the sleeve 3. This is performed with the tobacco rod ends of the smoking articles first to remove the partially sealed sealable material 1 from the sleeve 3, since the forward ends of the smoking articles 5 having passed through the inner channel 31 of the sleeve 3 abut against the sealed bottom 14 of the partially sealed sealable material 1.

The partially sealed sealable material 1 containing the smoking articles is then pushed into a holder 4 which is close to the sleeve 3. The top of the bundle 1 is then closed by folding the two small side flaps and the two long side flaps 151, 152 (see FIG. 1) against the filters of the smoking articles 5 in a manner so as to overlap while the partially sealed sealable material 1 is held by the holder 4. Sealing is then performed along the top seam 150 (see FIG. 1) against the filters while the partially sealed sealable material 1 is held by the holder 4, thus producing the sealed bundle 1 containing the smoking articles.

As has already been mentioned above, in case refill packs are to be produced for a refillable outer container, for example for rigid hinged lid packs, the sealable material is for example a mono-material plastic film, for example made from oriented polypropylene (OPP) or polyethylene terephthalate (PET). If desired the plastic film may be metalized to provide improved barrier properties.

Alternatively, the sealable material may be a multi-layer film, for example a laminated film comprising a layered structure of oriented polypropylene (OPP)-aluminum (Al)-oriented polypropylene (OPP) or a layered structure of polyethylene terephthalate (PET)-aluminum-polyethylene terephthalate (PET). Of course, it is also possible to use materials other than aluminum as the high barrier layer, for example ethylene vinyl alcohol copolymer (EVOH) or polyvinylidene chloride (PVDC). Other combinations are also envisaged to be used, for example combinations of paper layers with an aluminum layer.

The outermost layer of the sealable material may be printable. This is advantageous with respect to branding and the like. Different printing processes may be used. However, reverse gravure printing may be preferred so that the design and graphics are protected by the outside layer. In that case the outside layer must be at least partially transparent to allow the printing to be seen therethrough.

This method of producing a sealed bundle containing smoking articles may be used for various types of cigarettes, for example smoking articles being different in blend, circumference or length for various numbers of smoking articles (from 5 up to 30) as well as for various collations of a given number of smoking articles.

It may also be appreciated that different sealed bundles of smoking articles could be used together, for instance a bundle of 13 king sized smoking articles and a bundle of 7 shorter smoking articles into various types of applications, for instance into a refillable container.

The invention claimed is:

1. A method of producing a sealed bundle containing smoking articles, comprising the steps of:

providing a sleeve comprising an inner channel, and an outer surface;

wrapping a sealable material around an outer surface of the sleeve;

at least partially heat sealing the sealable material while being wrapped around the sleeve at a bottom and along a length of the sleeve;

pushing a group of smoking articles through the inner channel of the sleeve into the partially sealed sealable material so as to remove the partially sealed sealable material from the sleeve; and heat sealing the partially sealed sealable material at the top so as to form the sealed bundle, wherein the group of smoking articles is a group of filter cigarettes, each with a rod end and a filter end, wherein the group of smoking articles is pushed with the rod ends first through the inner channel of the sleeve into the partially heat sealed sealable material, and wherein the heat sealing of the top is performed against the filter ends of the smoking articles so as to prevent contact of tobacco material with heat during heat sealing.

2. A method according to claim 1, wherein the sealable material is wrapped around the sleeve such that first and second ends of the sealable material overlap to form a side seam which is then sealed, wherein overlapping flaps of the partially heat sealed sealable material are then folded against a plane surface provided at the bottom of the sleeve, the overlapping flaps forming a bottom seam which is then heat sealed to form the sealed bottom of the partially sealed sealable material, and wherein the plane surface is then removed from the sleeve so as to allow the group of smoking articles to be pushed through the inner channel of the sleeve into the partially sealed sealable material.

3. A method according to claim 1, wherein a holder is arranged close to the sleeve with the group of smoking articles being pushed through the inner channel of the sleeve in order to push the smoking articles together with the partially heat sealed sealable material from the sleeve into the holder, wherein the partially heat sealed sealable material held by the holder is then closed at its top by folding overlapping flaps of the partially heat sealed sealable material against the ends of the smoking articles to form a top seam.

4. A method according to claim 1, wherein the sealable material is a mono-material plastic film.

5. A method according to claim 1, wherein the sealable material is oriented polypropylene or polyethylene terephthalate.

6. A method according to claim 1, wherein the sealable material is a multi-material film.

7. A method according to claim 1, wherein the sealable material is a laminated film comprising a structure of oriented polypropylene-aluminum-oriented polypropylene.

8. A method according to claim 1, wherein the outermost surface of the sealable material is printable.

9. A method according to claim 1, wherein the sealable material is provided with at least one tear tape adapted to open the sealed bundle.

10. A method according to claim 1, wherein the outer surface of the sleeve has a width and depth essentially corresponding to the inner width and depth of the bundle to be produced.

* * * * *